US005911552A

United States Patent [19]

Shimizu et al.

[11] Patent Number: 5,911,552

[45] Date of Patent: Jun. 15, 1999

[54] SEAMING DIMENSION ADJUSTING DEVICE IN A DOUBLE SEAMING APPARATUS

[75] Inventors: Takashi Shimizu; Yasuyoshi Ina; Yoshihiko Kimura, all of Kanagawa, Japan

[73] Assignee: Toyo Seikan Kaisha, Ltd., Tokyo, Japan

[21] Appl. No.: 08/991,986

[22] Filed: Dec. 17, 1997

[30] Foreign Application Priority Data

Dec. 17, 1996 [JP] Japan ..... 8-353378

[51] Int. Cl.[6] ..... B21D 51/30

[52] U.S. Cl. ..... 413/31; 413/6; 413/27; 53/334

[58] Field of Search ..... 413/41, 40, 30, 413/6, 56, 62, 31, 27; 53/488, 334, 349, 325

[56] References Cited

U.S. PATENT DOCUMENTS

| | | | |
|---|---|---|---|
| 1,819,250 | 8/1931 | Lange | 413/41 |
| 2,216,082 | 9/1940 | Kronquest et al. | 413/31 |
| 2,966,871 | 1/1961 | Gear | 413/56 |
| 4,540,323 | 9/1985 | Inoue et al. | 413/6 |
| 5,358,369 | 10/1994 | Katou et al. | 53/334 X |

FOREIGN PATENT DOCUMENTS 8-197176 8/1996 Japan .

*Primary Examiner*—James F. Coan

*Attorney, Agent, or Firm*—Sughrue, Mion, Zinn, Macpeak & Seas, PLLC

[57] ABSTRACT

A seaming dimension adjusting device in a double seaming apparatus for double seaming a can by successive action of a first seaming roller and a second seaming roller, said seaming apparatus including a seaming chuck, a seaming roller shaft, first and second seaming rollers mounted on a lower end portion of said seaming roller shaft and a double seaming cam which actuates an upper end portion of said seaming roller shaft for shifting said first seaming roller and said second seaming roller either toward or away from said seaming chuck, wherein said seaming dimension adjusting device comprises a double seaming cam having a profile face, including a first seaming cam having a maximum displacement section of said first seaming roller and a second seaming cam having a maximum displacement section of said second seaming roller, at least one of said first seaming cam and said second seaming cam has a seaming cam adjusting means for adjusting the displacement of the maximum displacement section of the seaming roller in the seaming cam radial direction, and the shifting direction at a boundary portion between said first and second seaming cams is nearly tangential to the profile face of the cam.

20 Claims, 6 Drawing Sheets

SEAMING DIMENSION ADJUSTING DEVICE IN A DOUBLE SEAMING APPARATUS

FIELD OF THE INVENTION

The present invention relates to a seaming dimension adjusting device in a double seaming apparatus. More particularly, the present invention relates to a seaming dimension adjusting device capable of simultaneously adjusting the displacements of one or both of first and second seaming rollers in each station of a multiple station roll-type double seaming can closing apparatus.

BACKGROUND OF THE INVENTION

In a double seaming apparatus, the intermediate seaming thickness at the end of first seaming (hereinafter referred to as the dimension Tc) or the seaming thickness of the final shape at the end of second seaming (hereinafter referred to as the dimension T) sometimes changes due to heat expansion resulting from an increase in temperature. This increase in temperature is caused by frictional heat or the like of the seaming rollers during the seaming work over a long period of time. To cope with this change or when the kind of can is changed, the displacements of a first seaming roller and a second seaming roller to the seaming chuck are controlled to adjust the seaming dimension. Generally, in adjusting the seaming dimension, the fixing angle of the individual seaming rollers to a roller fixing axis is finely hand adjusted by a skilled person. In order to accomplish the adjustment more simply, a method of simultaneously adjusting a plurality of rollers has been proposed.

Examples of the method of simultaneously adjusting the slippage of a plurality of seaming rollers hitherto proposed include a method of dividing a part of the double seaming cam and moving the divided portion in the radial direction, and a method of pivoting the seaming cam around a fulcrum to thereby effect movement in a horizontal direction as disclosed, for example, in JP-A-8-168837 and JP-A-8-197176 (the term "JPA" as used herein means an "unexamined published Japanese patent application").

In conventional methods of simultaneously adjusting the displacements of seaming rollers, for example, in the method of dividing a part of a double seaming cam and moving the boundary portion in the radial direction, when the divided part is shifted in the radial direction, a step is generated in the cam groove at the boundary portion between the fixed part and the divided part. The cam follower is shocked on passing the stepped portion and as a result, the seaming rollers are vibrated which can give rise to a seaming failure. Thus, this method is disadvantageous in that high-speed double seaming cannot be performed. The method of pivoting the seaming cam as a whole also presents a problem. That is, because the maximum displacement sections of the first and second seaming rollers are shifted together, the maximum displacement sections of the first and second seaming rollers cannot be individually adjusted.

SUMMARY OF THE INVENTION

The present invention solves the above problems encountered in conventional methods of simultaneously adjusting the displacements of the seaming rollers. Accordingly, an object of the present invention is to provide a seaming dimension adjusting device in a double seaming apparatus, wherein a step is not generated in the cam groove at the boundary portion even when the divided portion is moved in the radial direction. In this manner, high-speed double seaming can be performed, and at the same time, the maximum displacement of the first seaming roller and the maximum displacement of the second seaming roller can be separately adjusted.

As a result of extensive investigations toward solving the above-described problems, the present inventors discovered that high-speed double seaming can be carried out without causing any step in the cam profile face at the boundary portion. This is accomplished by dividing a double seaming cam into a first seaming cam having a maximum displacement section of a first seaming roller and a second seaming cam having a maximum displacement section of a second seaming roller, and setting the shifting direction of the divided portion to trace the tangential direction of the cam profile face at the boundary portion. The present invention has been accomplished based on this finding.

BRIEF DESCRIPTION OF THE DRAWINGS

FIG. 1(*b*) is an enlarged view of the cross section along I—I of the device of FIG. 1(*a*);

DETAILED DESCRIPTION OF THE INVENTION

Figure 1A:
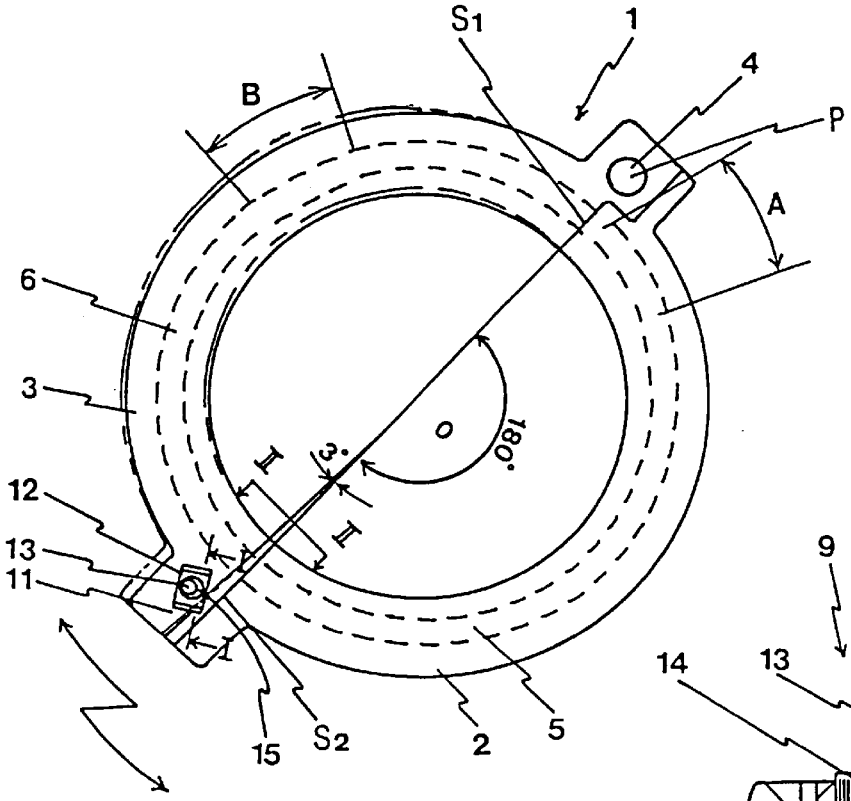
FIG. 1(*a*) is a plan view showing the main parts of a seaming dimension adjusting device according to one embodiment of the present invention.

The multiple station double seaming can closing apparatus for use in the present invention includes first and second seaming rollers at each station which successively and repetitively carry out a working cycle for forming a double seam and a seaming chuck. The seaming rollers are mounted at a lower end portion of a seaming roller shaft. A double seaming cam actuates an upper end portion of the seaming roller shaft for shifting the first seaming roller or the second seaming roller either toward or away from the seaming chuck.

The seaming dimension adjusting device of the present invention comprises a double seaming cam divided into a first seaming cam having a maximum displacement section of a first seaming roller and a second seaming cam having a maximum displacement section of a second seaming roller. At least one of the first seaming cam and the second seaming cam have a seaming cam adjusting means for adjusting the displacement of the maximum displacement section of the seaming roller in the seaming cam radial direction. Furthermore, the shifting direction of the boundary portion is set to trace the tangential direction of the profile face of the cam.

Either one or both of the first seaming cam and the second seaming cam can be shifted, whereby the Tc dimension, the T dimension or both of these dimensions can be adjusted. Also, for example, the second seaming cam is movable in the horizontal direction and at the same time, a second seaming cam adjusting means is disposed, whereby the maximum displacement section of the second seaming roller is shifted in the radial direction of the double seaming cam. A specific means therefor can comprise a double seaming cam divided into a first seaming cam and a second seaming cam such that the second seaming cam can pivot relative to a pivot center preferably in the vicinity of the maximum displacement section of the first seaming roller, wherein one boundary portion between the first seaming cam and the second seaming cam lies almost on a line drawn by connecting the pivot center and the center of the double seaming cam, and the angle formed by one boundary portion and another boundary portion relative to the center of the double seaming cam is nearly 180°.

Another specific means which can be used comprises a double seaming cam divided into a first seaming cam and a second seaming cam such that the second seaming cam can move horizontally along linear guides relative to the first seaming cam, wherein one boundary portion is placed on the surface perpendicular to the linear guide preferably in the vicinity of the maximum displacement section of the first seaming roller, and the angle formed by the line connecting the two boundary portions and the center of the cam is nearly 180°.

Furthermore, when the double seaming cam is divided such that in the boundary portion between the first seaming cam and the second seaming cam at least the cam profile face is slanted at the terminal edge or at least the cam profile face has an overlapping member or preferably an inserted lap portion at the terminal edge, the cam follower is in contact with the cam profile face to generate substantially no backlash. As a result, the double seaming can be advantageously performed at a higher speed.

PREFERRED EMBODIMENTS OF THE INVENTION

The practical embodiments of the present invention are described in detail below by referring to the accompanying drawings. However, the present invention should not be construed as being limited thereto.

Figure 1B:
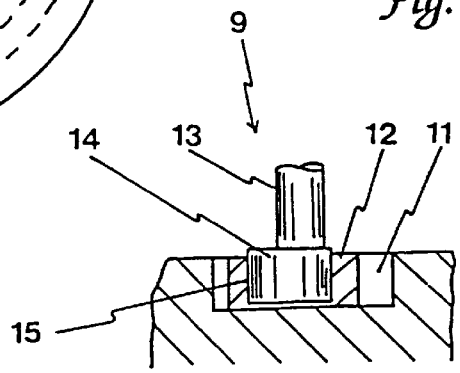

FIG. 1 is a schematic plan view of a seaming dimension adjusting device according to one embodiment of the present invention. In this embodiment, double seaming cam 1 is divided into a first seaming cam 2 and a second seaming cam 3. The first seaming cam 2 is fixed, and the second seaming cam 3 is connected so that it can pivot about the center of pin 4 relative to the first seaming cam 2. The first seaming cam 2 and the second seaming cam 3 each has on the surface thereof continuously formed cam grooves or tracks 5 and 6, respectively, so that they together complete a circle for shifting the first seaming roller and the second seaming roller toward the seaming chuck side. Cam groove 5 of the first seaming cam 2 is mostly projected outward at section A in the vicinity of the pin 4. The first seaming roller is mostly shifted toward the seaming chuck side in this section to have the greatest slippage, and the Tc dimension at the end of the first seaming is determined by this slippage.

The second seaming roller is mostly shifted toward the seaming chuck side in section B on cam groove 6 to have the greatest slippage, and the T dimension at the end of the final seaming is determined by this slippage. Accordingly, section A and section B are the maximum displacement sections of the first seaming roller and the maximum displacement section of the second seaming roller, respectively. These two sections are disposed to form an angle of about 90° relative to the center of the double seaming cam, as shown in FIG. 1.

With respect to the boundary portion between the first seaming cam 2 and the second seaming cam 3, one boundary Si lies on a line connecting pivot center P (namely, the center of pin 4) in the vicinity of the maximum displacement section of the first seaming roller between the maximum displacement section A of the first seaming roller and the maximum displacement section B of the second seaming roller of the double seaming cam, with the cam center at O. Another boundary $S_2$ is formed in a direction that is nearly 180° from the pivot center P relative to the cam center O.

In order to pivot the second seaming cam 3 about the center of pin 4 relative to the first seaming cam 2, a second seaming cam adjusting means 9 is provided at a position nearly symmetrical to pin 4, namely, in the outer periphery of the surface of the second seaming cam in the vicinity of the boundary $S_2$. In the embodiment shown in FIG. 1, the second seaming cam adjusting means 9 is constructed such that a long groove 11 is formed on the surface of second seaming cam 3 at a position nearly symmetrical to pin 4, and slider 12 having a circular hole 15 formed at the center thereof is shiftably engaged with the long groove. In circular hole 15, eccentric top 14 with projection of shaft 13 is rotatably formed in an eccentric position. Shaft 13 is connected to an appropriate actuator such as a servo motor installed to the fixed part of the double seaming apparatus body and driven to rotate at this position. A servo motor is preferably used as the actuator because the rotation angle of the eccentric top, namely, the shifting position of the first seaming cam, can be accurately controlled, however, the present invention is not limited thereto and other actuators can be used. Furthermore, without the aid of an actuator, shaft 13 may be supported by fitting the upper portion thereof into a bearing provided on the double seaming apparatus body and rotated manually by a dial provided at the edge part of the projection.

The double seaming apparatus according to this embodiment is constructed as described above. For adjusting the T dimension in the finally seamed shape, the rotation of shaft 13 in the second seaming cam adjusting means of FIG. 1 is stopped at a predetermined angle, second seaming cam 3 is pivoted according to the rotation angle of the shaft relative to the pivot center at pin 4 to shift the maximum displacement section B on the cam groove of the second seaming cam in the radial direction such that the slippage of the second seaming cam can be adjusted. In this way, by controlling the rotation angle of shaft 13, the slippage of the second seaming cam can be adjusted within a range corresponding to the eccentricity δ of the eccentric top. Shaft 13 can be momentarily rotated by an appropriate actuator and therefore, the double seaming work can be performed without any break.

A step is formed in the cam groove (namely, the profile face) between the first seaming cam 2 and the second seaming cam 3 at the boundary portion opposite the pivot point. However, in this embodiment, the boundary portion of the second seaming cam is located nearly 180° from the pivot point. Therefore, the second seaming cam only moves in the tangential direction at the boundary portion. As a result, a step is scarcely formed in the cam profile face at the boundary portion even if the second seaming cam is pivoted. Accordingly, the cam follower is not shocked or vibrated due to the step even when it passes the boundary portion of the two seaming cams, and the seaming can be performed accurately and smoothly.

As the boundary portion of the second seaming cam departs from the line connecting the pivot point and the point 180° therefrom, the step becomes larger. In the divided cam hitherto proposed, the dividing line was drawn to form an angle of from 60 to 160° and, for example, when the cam was divided at the middle angle of 110° and when the seaming roller maximum displacement section of the second seaming cam was moved 0.50 mm, the step in the profile face at the boundary reached 0.47 mm. On the other hand, in the present invention using a 180° division, the step formed in the profile face is about 0.007 mm in height and this is a level which causes substantially no problem in practice. More particularly, the level in step height in the profile face which causes no problem is empirically 0.05 mm. This step height is available when the dividing angle falls within the range of 180°±3° in the case of a double seaming cam having a diameter of 560 mm. If the double seaming cam has a larger diameter, then a larger variation from 180° can be tolerated. On the other hand, if the double seaming cam has a smaller diameter, only a smaller variation from 180° can be tolerated such that the step height is acceptable. Generally, as used herein, the terms "nearly tangential" and "nearly 180°" mean "tangential ±6°" and "180°±6°", respectively, and preferably ±3° for each of these terms. These ranges are determined geometrically, for example, as the resulting level is step height which is practically useful in the invention.

Figure 2:
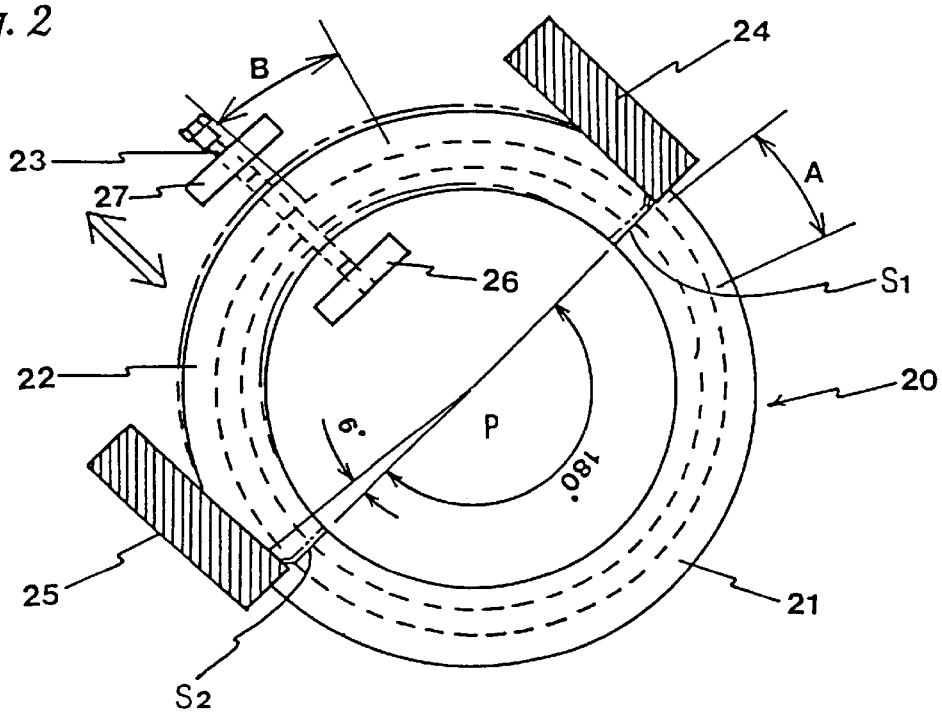
FIG. 2 is a plan view showing the main parts of a seaming dimension adjusting device according to another embodiment of the present invention.

FIG. 2 shows another embodiment in which the displacement of the maximum displacement section of the second seaming roller of the second seaming cam in the seaming cam radial direction is adjusted such that the sifting direction of the boundary portion traces the tangential direction of the cam profile face.

In this embodiment, double seaming cam 20 is constructed such that the second seaming cam 22 is regulated by screw 23 relative to the first seaming cam 21 to move along linear guides 24 and 25. Double seaming cam 20 is divided into a first seaming cam 21 and a second seaming cam 22 between the maximum displacement section A of the first seaming cam and the maximum displacement section B of the second seaming cam. A first boundary portion between the first seaming cam and the second seaming cam is disposed on a surface perpendicular to a linear guide in the vicinity of the maximum displacement section of the first seaming cam, and the angle formed by lines connecting each of the first boundary portion and a second boundary portion with the cam center P is nearly 180°. In FIG. 2, numerals 26 and 27 each is a bearing plate of the screw 23 installed to the fixed double seaming apparatus body.

In the embodiment shown in FIG. 2, for adjusting the T dimension, screw 23 is rotated to shift the second seaming cam 22 along the linear guides 24 and 25. As a result, the maximum displacement section B of the second seaming roller is shifted in a radial direction, whereby the slippage of the second seaming roller can be adjusted. At this time, boundary portions $S_1$ and $S_2$ of the second seaming cam move in a tangential direction and therefore, almost no step is generated in the cam profile face. As a result, similarly to the previous embodiment, the cam follower is not shocked or vibrated due to the step on passing the boundary portions of the double seaming cam, and the double seaming can be performed accurately and smoothly. In the embodiment shown in FIG. 2, the dividing angle is 180°±6° so that the step height in the profile face is about 0.05 mm which is satisfactory for practical use.

As in the embodiments shown in FIG. 1 and FIG. 2, a construction such that the shifting direction at the boundary portion traces the tangential direction of the cam profile face prevents the profile face at the boundary portion from generating a step and good double seaming can be performed. Furthermore, in a still preferred embodiment of the present invention, the profile face at the boundary portion is substantially continued and the cam follower is always placed into contact with the profile face, whereby the double seaming can be performed smoothly and without causing any vibration of the cam follower even during high-speed double seaming. A practical embodiment of the cam connecting portion therefor is shown in FIGS. 3 and 4.

Figure 3:
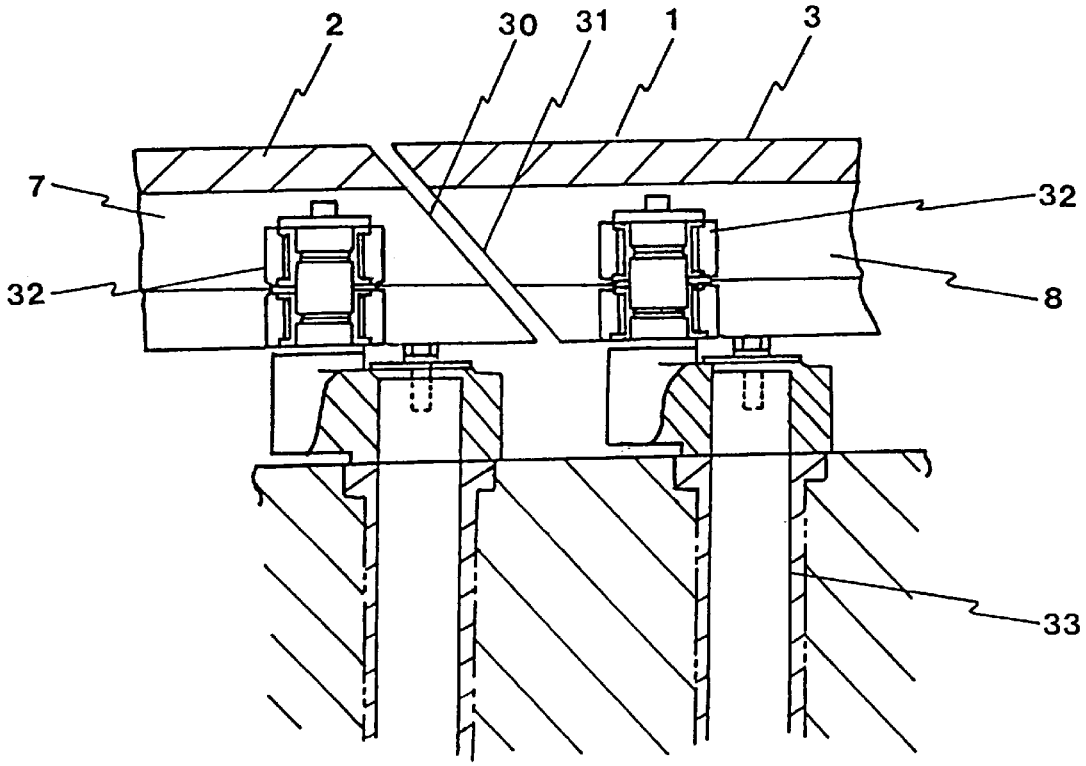
FIG. 3 is an enlarged view of the cross section along II—II of the device of FIG. 1(*a*)

In the embodiment of the present invention shown in FIG. 3, double seaming cam 1 is divided by cutting it obliquely from the upper part to the lower part and then, the terminal edges 30 and 31 of the profile face of the first seaming cam 2 and the second seaming cam 3 formed at the boundary portion are slanted. In this manner, the cam follower 32 is always in contact with either one of profile faces 7 and 8 of the first seaming cam 2 and the second seaming cam 3 to generate substantially no backlash such that high-speed seaming can be performed. In FIG. 3, numeral 33 is a seaming roller shank shaft.

Figure 4:
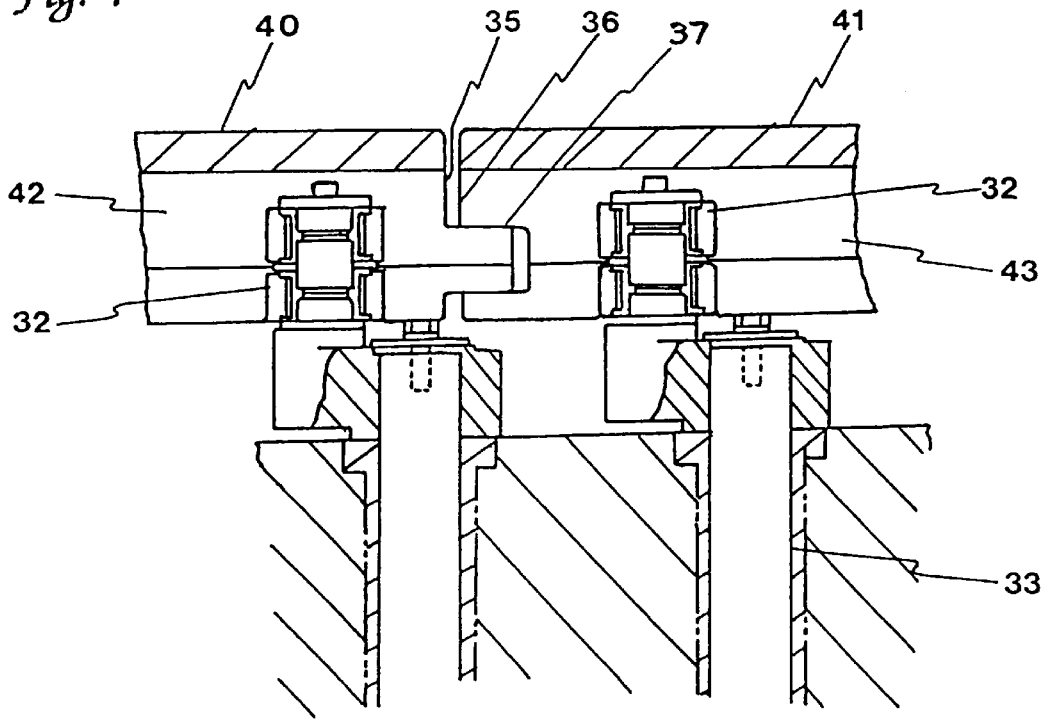
FIG. 4 is an enlarged view of the cross section corresponding to FIG. 3 according to yet another embodiment of the present invention.

In the embodiment shown in FIG. 4, the double seaming cam is divided such that terminal edges 35 and 36 of the profile faces in the cam grooves are inserted into each other nearly in the middle of their height to form lap portion 37, and the profile faces 42 and 43 of the first seaming cam 40 and the second seaming cam 41 are lapped. As a result, the cam follower 32 is always in contact with either one of the profile faces of the first seaming cam and the second seaming cam even when, for example, the second seaming cam 41 is shifted to a maximum amount. As a result, backlash is substantially eliminated similarly to the previous embodiment and high-speed seaming can be performed.

Figure 5:
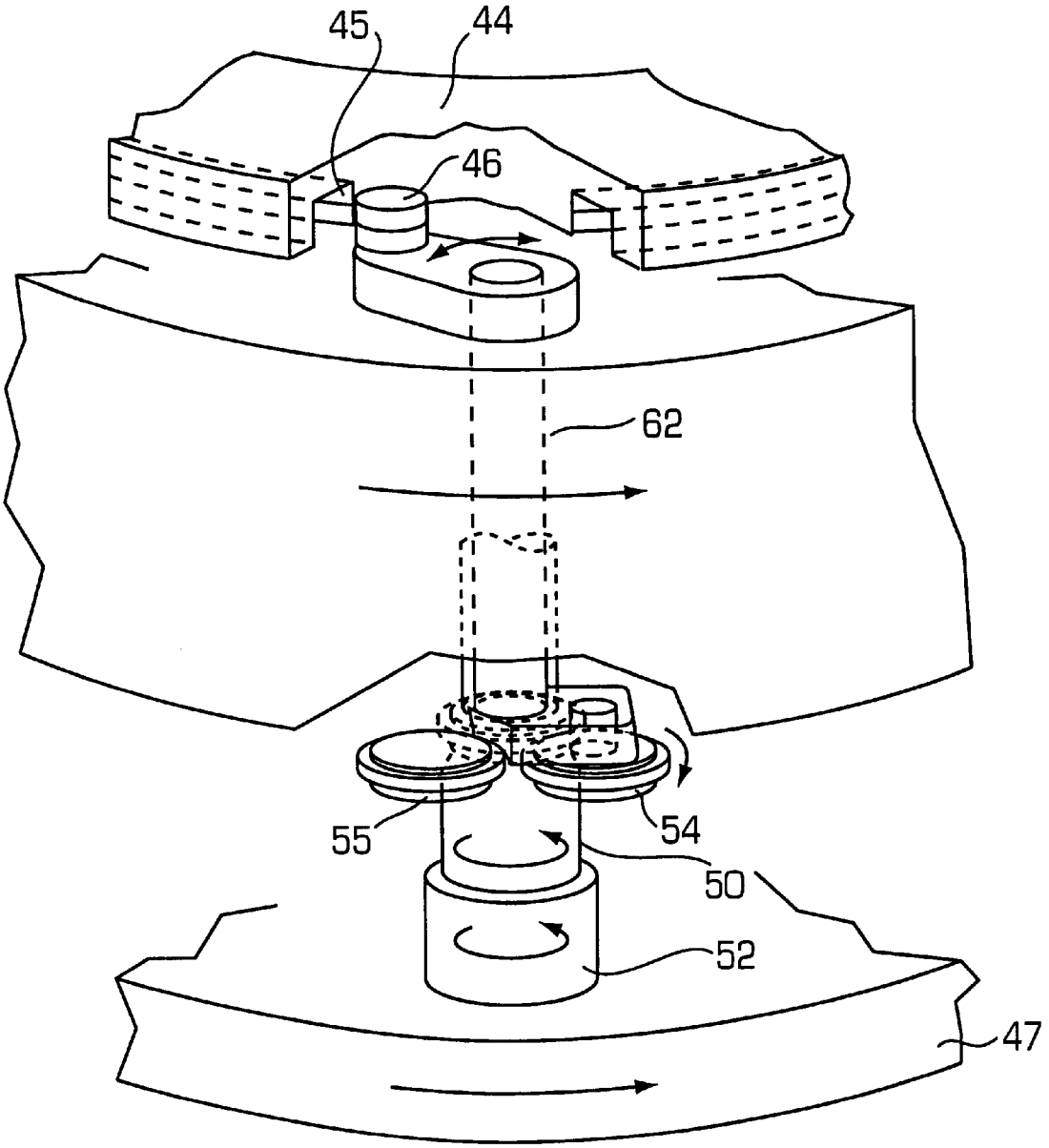
FIGS. 5 and 6 are vertical views of a double seaming apparatus for use in the present invention.

FIG. 5 is a general view of a double seaming apparatus for use in the present invention, showing rotating table 47, can lifter 52, stationary double seaming cam 44 including track or groove 45, cam follower 46, first and second seaming rollers 54 and 55, respectively, and seaming roller shank shaft 62. The first and second seaming rollers are mounted on a lower end portion of the shank shaft 62. An upper end portion of the shank shaft 62 engages cam track or groove 45 via cam follower 46.

Figure 6:
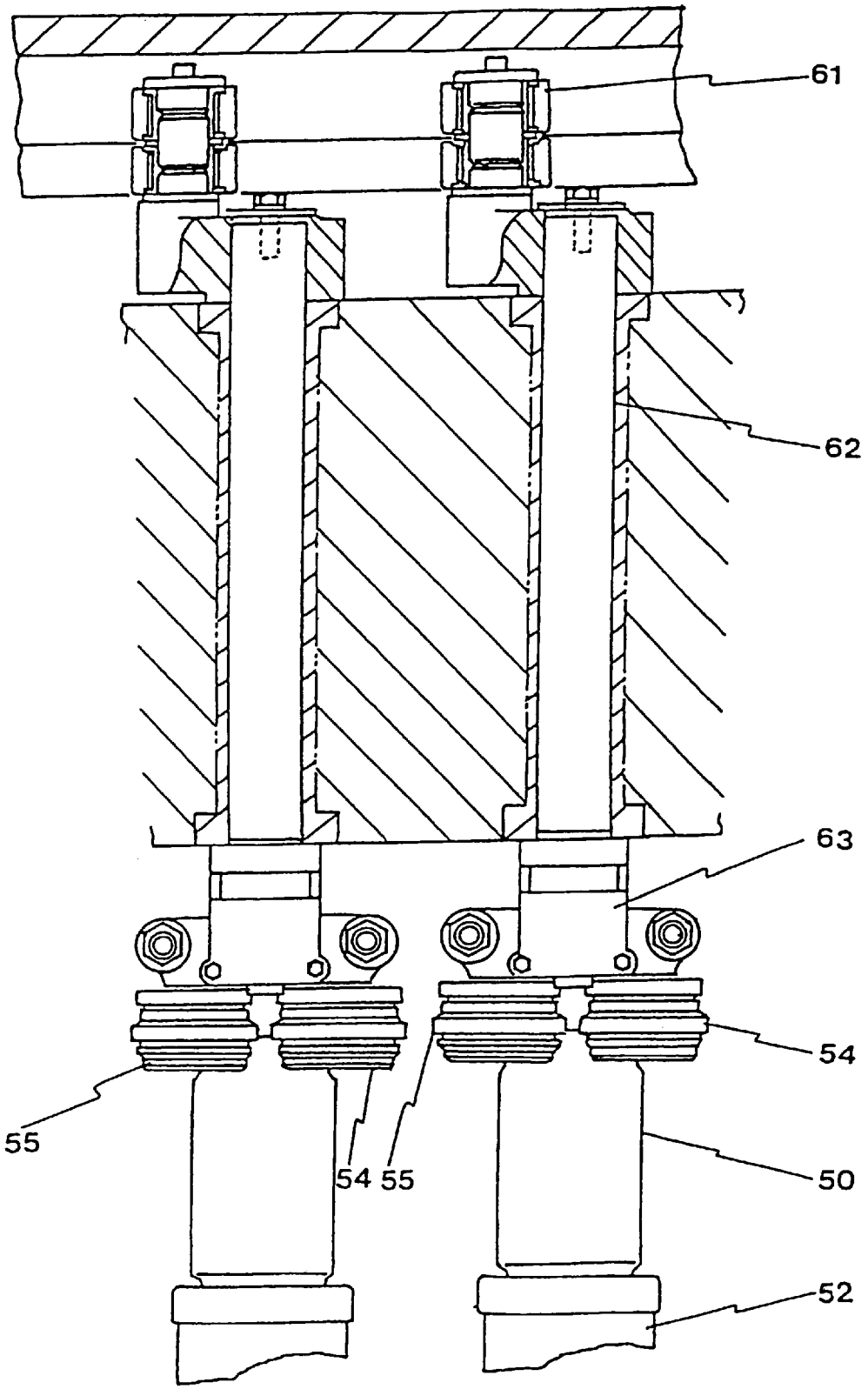

FIG. 6 is another vertical view of a double seaming apparatus for use in the present invention, showing can lifter 52, can body 50, first and second seaming rollers 54 and 55, respectively, seaming head 63, shank shaft 62 and cam follower 61.

Figure 7:
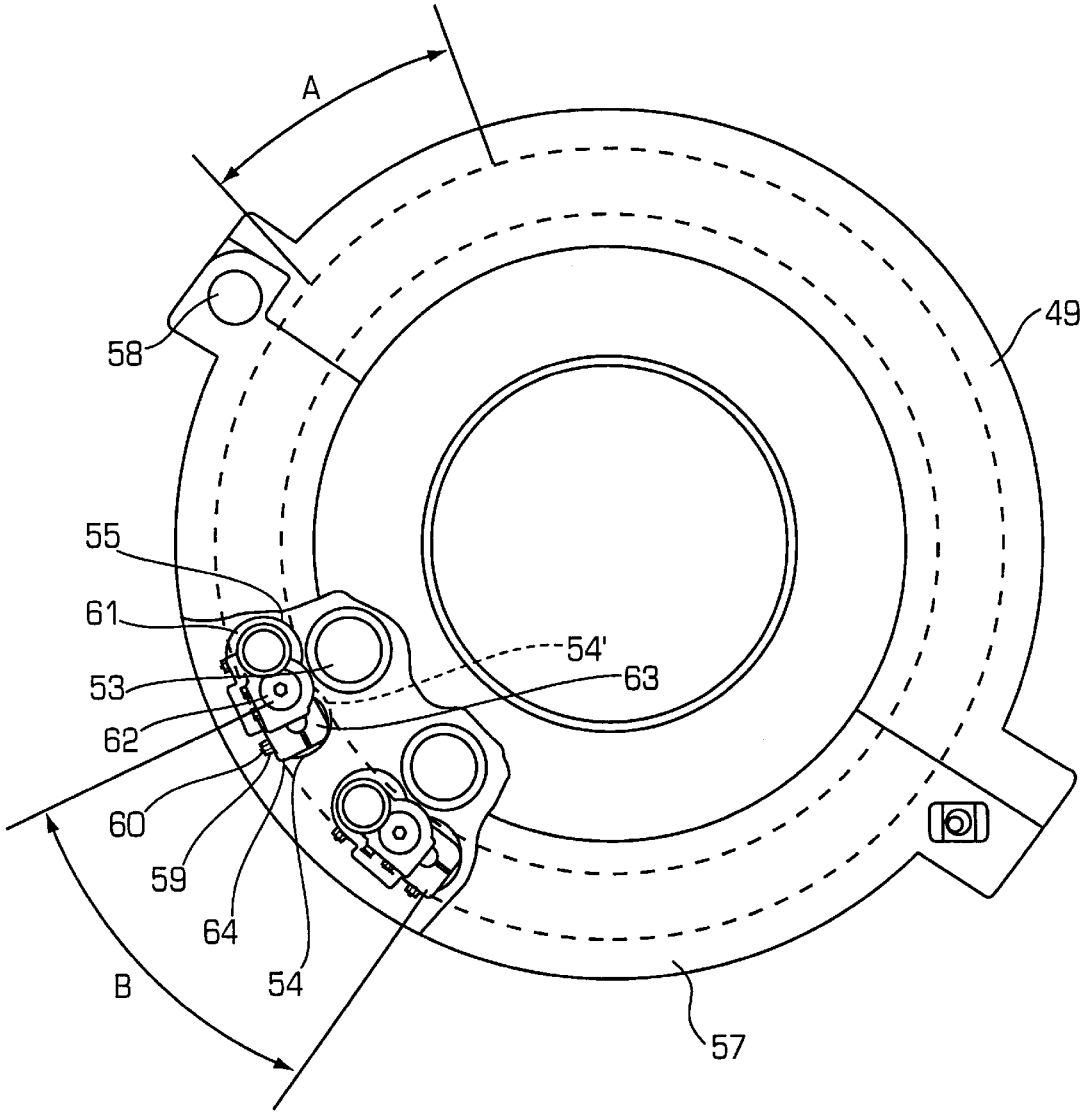
FIG. 7 is a plan view of a double seaming apparatus including a seaming dimension adjusting device in accordance with the present invention.

FIG. 7 is a plan view of a double seaming apparatus including a seaming dimension adjusting device in accordance with the present invention. FIG. 7 shows first seaming cam 49, second seaming cam 57, pivot pin 58, maximum displacement sections A and B, first and second seaming rollers 54 and 55, respectively, seaming chuck 53, cam follower 61, shank shaft 62 and seaming head 63. The seaming rollers move either toward or away from the seaming chuck as the cam follower follows the path of the first and second seaming cams (as shown by the outline 54').

Figure 8A:
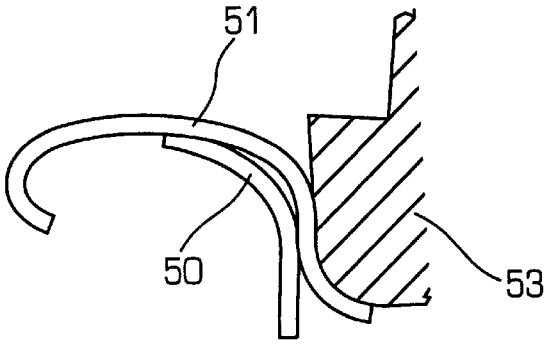
FIGS. 8(*a*) to 8(*c*) are cross sections showing the steps of forming a double seam.
Figure 8B:
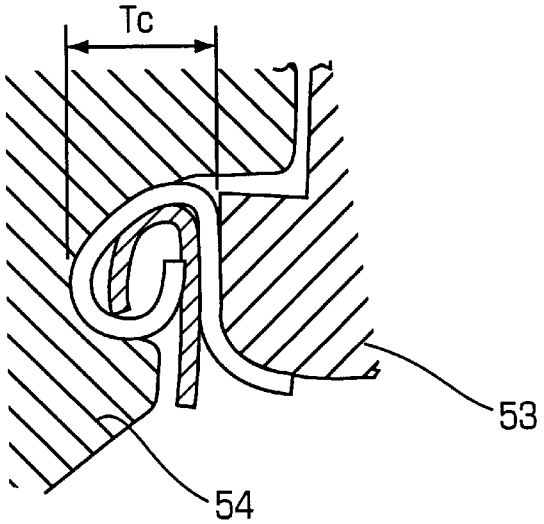
Figure 8C:
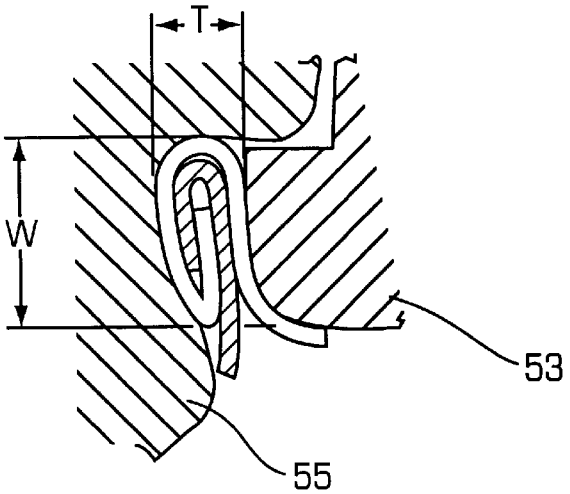

FIGS. 8(*a*) to 8(*c*) are cross sections showing the steps of forming a double seam for attaching a can lid to a can. In the double seaming apparatus, the can body 50 is received on a lifter pad 52, and the can lid 51 is loosely applied to the top open end of the can body 50 with the lid and body flanges overlapping as shown in FIG. 8(*a*).

The lifter pad 52 lifts the can body 50 with its loosely applied lid upwardly into the seaming head 63 as shown in FIG. 6, where the seaming chuck 53 fits into the can lid with the outer edge of the chuck engaging and backing-up the upright wall of the lid.

The lifter pad 52 firmly clamps the can body and its closure lid tightly against the chuck to prevent slippage of the lid relative to the chuck while the seaming rollers 54, 55 move towards the chuck to successively carry out the first and second seaming operations.

The double seaming cam including first seaming cam 49 and second seaming cam 57 as shown in FIG. 7 controls the movement of the seaming rollers for carrying out the double seaming operation. The first seaming roller forms a seam by interlocking the curled edge of the end of the lid 51 with the flange of the can body 50 as shown in FIG. 8 (*b*). This is effected by shifting the first seaming roller 54 toward the seaming chuck 53 in the cam section A. $T_c$ is the intermediate seaming thickness at the end of the first seaming step. The second seaming roller 55 compresses the seam thus formed to make a strong leak-proof seam. This is effected by shifting the second seaming roller 55 toward the seaming chuck 53 in the cam section B as shown in FIG. 8 (*c*). T is the seaming thickness at the end of the second seaming step. W is the width of the completed seam.

Various embodiments of the present invention are described above, however, the present invention is by no means limited to these embodiments and the design can be modified in various ways. For example, although the second seaming cam is shifted to adjust the maximum displacement of the second seaming roller in the embodiments described above, a first seaming cam adjusting means may be provided to adjust the maximum displacement of the first seaming roller. Furthermore, when the first seaming cam and the second seaming cam both are arranged so that they are capable of shifting, the Tc dimension, the T dimension or both of these dimensions can be adjusted.

As described above, by dividing the double seaming cam so that the shifting direction of the first seaming cam and the second seaming cam at the boundary portion traces the tangential direction of the cam profile face, the respective cams can be separately adjusted, the step in the profile face at the boundary portion can be eliminated even when only one seaming cam is shifted, the cam follower is not shocked or vibrated when passing the boundary portions of the double seaming cam to thereby achieve accurate and smooth double seaming, and the seaming dimension can be effectively adjusted. Furthermore, by employing the construction of FIGS. 1 or 2, the second seaming cam can be simply and correctly shifted in a simple mechanism without causing any step at the boundary portions.

Furthermore, when the terminal edge of the cam profile face at the boundary is slanted or has a partially lapped portion, the profile face at the boundary substantially continues and no backlash is generated even when one seaming cam is shifted. As a result, the cam follower is always placed into contact with the profile face and moves smoothly, and accordingly, high-seed double seaming can be carried out.

While the invention has been described in detail and with reference to specific embodiments thereof, it will be apparent to one skilled in the art that various changes and modifications can be made therein without departing from the spirit and scope thereof.

What is claimed is:

1. A seaming dimension adjusting device in a double seaming apparatus for double seaming a can by successive action of a first seaming roller and a second seaming roller, said seaming apparatus including a seaming chuck, a seaming roller shaft, first and second seaming rollers mounted on a lower end portion of said seaming roller shaft and a double seaming cam which actuates an upper end portion of said seaming roller shaft for shifting said first seaming roller and said second seaming roller either toward or away from said seaming chuck, wherein said seaming dimension adjusting device comprises a double seaming cam having a profile face, including a first seaming cam having a maximum displacement section of said first seaming roller and a second seaming cam having a maximum displacement section of said second seaming roller, at least one of said first seaming cam and said second seaming cam has a seaming cam adjusting means for adjusting the displacement of the maximum displacement section of the seaming roller in the seaming cam radial direction, and the shifting direction at a boundary portion between said first and second seaming cams is nearly tangential to the profile face of the cam.

2. The seaming dimension adjusting device as claimed in claim 1, wherein said double seaming cam actuates said seaming roller shaft via a cam follower.

3. The seaming dimension adjusting device as claimed in claim 1, wherein said double seaming apparatus includes a plurality of double seaming units each comprising a seaming chuck, first and second seaming rollers and a seaming roller shaft.

4. The seaming dimension adjusting device as claimed in claim 1, wherein said second seaming cam is movable in a horizontal direction and has a second seaming cam adjusting means for shifting the maximum displacement section of the second seaming roller in a radial direction of the double seaming cam.

5. The seaming dimension adjusting device as claimed in claim 4, wherein said second seaming cam is pivotally mounted at a pivot center, a first boundary portion between the first seaming cam and the second seaming cam lies almost on a line drawn by connecting said pivot center and the center of the double seaming cam, and the angle formed by said first boundary portion and a second boundary portion relative to the center of the double seaming cam is nearly 180°.

6. The seaming dimension adjusting device as claimed in claim 4, wherein said second seaming cam is movable horizontally along linear guides relative to said first seaming cam, a first boundary portion between the first seaming cam and the second seaming cam is disposed on a surface perpendicular to the linear guides, and the angle formed by lines connecting each of said first boundary portion and a second boundary portion with the center of the double seaming cam is nearly 180°.

7. The seaming dimension adjusting device as claimed in claim 1, wherein said double seaming cam is divided so that in a boundary portion between the first seaming cam and the second seaming cam at least a terminal edge of the cam profile face is slanted.

8. The seaming dimension adjusting device as claimed in claim 4, wherein said double seaming cam is divided so that in a boundary portion between the first seaming cam and the second seaming cam at least a terminal edge of the cam profile face is slanted.

9. The seaming dimension adjusting device as claimed in claim 5, wherein said double seaming cam is divided so that in a boundary portion between the first seaming cam and the second seaming cam at least a terminal edge of the cam profile face is slanted.

10. The seaming dimension adjusting device as claimed in claim 6, wherein said double seaming cam is divided so that in a boundary portion between the first seaming cam and the second seaming cam at least a terminal edge of the cam profile face is slanted.

11. The seaming dimension adjusting device as claimed in claim 1, wherein said double seaming cam is divided so that a boundary portion including a cam profile having terminal edges between the first seaming cam and the second seaming cam has a member which overlaps the terminal edges of the cam profile.

12. The seaming dimension adjusting device as claimed in claim 4, wherein said double seaming cam is divided so that a boundary portion including a cam profile having terminal edges between the first seaming cam and the second seaming cam has a member which overlaps the terminal edges of the cam profile.

13. The seaming dimension adjusting device as claimed in claim 5, wherein said double seaming cam is divided so that a boundary portion including a cam profile having terminal edges between the first seaming cam and the second seaming cam has a member which overlaps the terminal edges of the cam profile.

14. The seaming dimension adjusting device as claimed in claim 6, wherein said double seaming cam is divided so that a boundary portion including a cam profile having terminal edges between the first seaming cam and the second seaming cam has a member which overlaps the terminal edges of the cam profile.

15. The seaming dimension adjusting device as claimed in claim 11, wherein said member is an inserted lap portion which overlaps the terminal edges of the cam profile.

16. The seaming dimension adjusting device as claimed in claim 12, wherein said member is an inserted lap portion which overlaps the terminal edges of the cam profile.

17. The seaming dimension adjusting device as claimed in claim 13, wherein said member is an inserted lap portion which overlaps the terminal edges of the cam profile.

18. The seaming dimension adjusting device as claimed in claim 14, wherein said member is an inserted lap portion which overlaps the terminal edges of the cam profile.

19. The seaming dimension adjusting device as claimed in claim 5, wherein said second seaming cam is pivotally mounted at a pivot center arranged in the vicinity of the maximum displacement section of the first seaming roller.

20. The seaming dimension adjusting device as claimed in claim 6, wherein said second seaming cam is disposed on a surface perpendicular to the linear guides in the vicinity of the maximum displacement section of the first seaming roller.

* * * * *